United States Patent [19]

Kasatkin et al.

[11] 4,001,523

[45] Jan. 4, 1977

[54] RIBBON LOUDSPEAKER

[76] Inventors: Alexei Fedoseevich Kasatkin, ulitsa Pravdy, 7/9, kv. 42; Jury Vasilievich Smirnov, ulitsa Alabiana, 11, kv. 44; Ilya Afanasievich Feldman, ulitsa Dubininskaya, 6 korpus 1, kv. 269, all of Moscow, U.S.S.R.

[22] Filed: Jan. 5, 1976

[21] Appl. No.: 646,545

[30] Foreign Application Priority Data

Jan. 14, 1975 U.S.S.R. ..... 2090005

[52] U.S. Cl. ..... 179/115 V

[51] Int. Cl.[2] ..... H04R 9/02

[58] Field of Search ..... 179/115 V

[56] References Cited

FOREIGN PATENTS OR APPLICATIONS 604,908 7/1948 United Kingdom ..... 179/115 V

*Primary Examiner*—George G. Stellar

*Attorney, Agent, or Firm*—Lackenbach, Lilling & Siegel

[57] ABSTRACT

According to the invention, the ribbon loudspeaker comprises permanent magnets defining a magnetic system and ribbons for sound reproduction received in the working gap between the pole faces of the permanent magnets. The electrically conductive layer of the sound reproducing ribbon has its thickness increasing from the lateral edges thereof, disposed adjacent to the pole faces of the permanent magnets, to the center portion thereof. The disclosed ribbon loudspeaker improves the quality of sound reproduction.

1 Claim, 2 Drawing Figures

RIBBON LOUDSPEAKER

The present invention relates to electroacoustical transducers and, more particularly, it relates to ribbon type loudspeakers.

The invention can be employed at designing of ribbon type electrical/acoustical transducers, such as ribbon loudspeakers. The latter are nowadays ever increasingly employed in domestic sound reproducing appliances, in cinema, in loudspeaker systems installed in concert and like halls, in short, in various places and applications where high fidelity of sound reproduction is required.

There are already known ribbon loudspeakers comprising permanent magnets defining therebetween a working gap accommodating therein a ribbon for sound reproduction, of which the thickness in the lateral direction is permanent.

The magnetic induction in the gap between the pole faces of the permanent magnets, while having relatively great values adjacent to the pole faces, substantially decreases toward the center of the working gap. Therefore, the electromagnetic force acting upon the edges of the sound reproducing ribbon is substantially greater than that acting upon the central portion thereof. Therefore, the oscillation of all the points of the sound reproducing ribbon would not be co-phasal or coherent to a high enough degree, on account of travelling waves developing across the width of the sound reproducing ribbon. The relatively great amplitude of the oscillation of the edges of the sound reproducing ribbon, in combination with the distorted or impaired co-phasal state of the oscillation, results in various distortions of the sound being reproduced. Besides, in this case the central portion of the sound reproducing ribbon acts, in fact, as a load relative to the edges thereof, which presents another source of sound distortion. And finally, since the oscillation is predominantly limited to the edges of the sound reproducing ribbon, the latter is permanently operating under a lateral bending load, which curtails its service life and might result in breakdowns.

One of the ribbon type loudspeakers of the prior art has the sound reproducing ribbon of which the thickness varies in the longitudinal direction, from a smaller thickness at the central portion of the ribbon toward a greater thickness at the terminal portions thereof, i.e. toward the points of suspension of the sound reproducing ribbon from the support frame. This feature is aimed at preventing the generation of standing waves in the sound reproducing ribbon caused by the interference of the travelling direct wave and the wave reflected from the suspension point. However, in this loudspeaker of the prior art the ribbon does not vary its thickness laterally, i.e. across the width thereof, at any given cross-section. Consequently, this last-described ribbon loudspeaker is not altogether free from the above-mentioned disadvantages associated with the non-uniformity of the magnetic flux across the working gap between the pole faces of the permanent magnet or magnets.

It is an object of the present invention to improve the quality of sound reproduced by a ribbon type loudspeaker and to prolong the service life of the sound reproducing ribbon thereof. This and other objects are attained in a ribbon loudspeaker comprising permanent magnets defining a magnetic system and sound reproducing ribbons, each ribbon being received in the working gap between the pole faces of the respective one of the permanent magnets, in which ribbon loudspeaker, in accordance with the invention, the electrically conductive layer on the ribbon has its thickness increasing from the edges of the sound reproducing ribbon, situated adjacent to the pole faces of the permanent magnets, toward the central portion thereof.

The essence of the present invention will be illustrated by a description of an embodiment thereof, with reference being had to the accompanying drawings, wherein.

Figure 1:
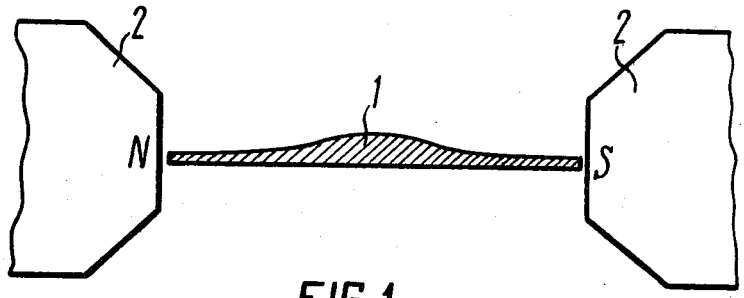
FIG. 1 is a lateral cross-sectional view of the sound reproducing ribbon.

Referring now in particular to the appended drawings, the ribbon type loudspeaker comprises a sound reproducing ribbon 1 (FIG. 1), shown in the appended drawing in lateral cross-section, received within the working gap between the pole faces N and S of the permanent magnet or magnets 2. The pole faces N and S of the permanent magnets 2 are shown in a projection perpendicular to the direction of the current of an audio frequency flowing through the sound reproducing ribbon 1. The thickness of the sound reproducing ribbon 1 increases from its edges adjacent to the pole faces N and S toward a maximum at the center thereof.

Figure 2:
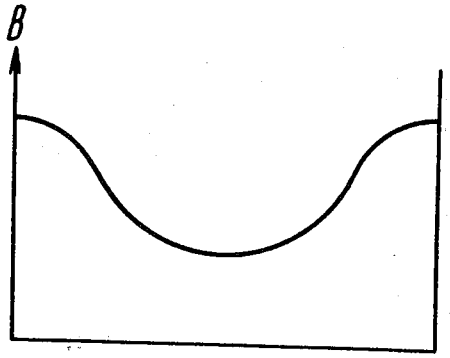
FIG. 2 is a graph showing the variation of the magnetic induction B within the working gap between the pole faces of the permanent magnets.

FIG. 2 of the appended drawings shows in a graphic form the variation of the magnetic induction B within the working gap between the pole faces N and S of the permanent magnets 2. The electric conductivity of the sound reproducing ribbon 1 across its width varies so that with an audio frequency current flowing through the sound reproducing ribbon 1, the following condition should be maintained:

$$B_i = \text{const} \qquad (1),$$

where $B_I$ is value of the magnetic induction along any arbitrarily selected longitudinal generatrix of the sound reproducing ribbon 1;

$i$ is the value of the audio frequency current along the same line.

With this condition satisfied in the presently disclosed ribbon loudspeaker, there is ensured the equality of the values of electromagnetic force at any point of the sound reproducing ribbon at any time.

What is claimed is:

1. A ribbon type loudspeaker comprising:

a. permanent magnets defining a magnetic system, a working gap being defined between pole faces of said permanent magnets; and b. at least one ribbon for sound reproduction having an electrically conductive portion received in said working gap between the pole faces of said permanent magnets, said electrically conductive portion having its thickness increasing from the edges of said sound reproducing ribbon, disposed adjacent to the pole faces of said permanent magnets, toward a maximum at the central portion of said sound reproducing ribbon.

* * * * *